US007025441B2

(12) United States Patent
Kashino et al.

(10) Patent No.: US 7,025,441 B2
(45) Date of Patent: Apr. 11, 2006

(54) INK JET PRINT HEAD

(75) Inventors: Toshio Kashino, Kanagawa (JP); Hiroyuki Kigami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 10/947,383

(22) Filed: Sep. 23, 2004

(65) Prior Publication Data

US 2005/0128548 A1 Jun. 16, 2005

(30) Foreign Application Priority Data

Dec. 12, 2003 (JP) ..... 2003-415727

(51) Int. Cl.
*B41J 2/14* (2006.01)

(52) U.S. Cl. ..... 347/50; 347/58; 347/59

(58) Field of Classification Search ..... 347/50, 347/56, 58, 59, 64
See application file for complete search history.

(56) References Cited

U.S. PATENT DOCUMENTS

| | | | | |
|---|---|---|---|---|
| 5,826,333 A | | 10/1998 | Iketani et al. | 29/890.1 |
| 5,943,074 A | | 8/1999 | Kashino et al. | 347/54 |
| 6,084,612 A | * | 7/2000 | Suzuki et al. | 347/50 |
| 6,099,109 A | * | 8/2000 | Komuro | 347/50 |
| 6,109,735 A | | 8/2000 | Kashino et al. | 347/65 |
| 6,168,254 B1 | | 1/2001 | Karita et al. | 347/20 |
| 6,257,703 B1 | * | 7/2001 | Hirosawa et al. | 347/50 |
| 6,378,992 B1 | | 4/2002 | Kudo et al. | 347/63 |
| 6,435,669 B1 | | 8/2002 | Nakata et al. | 347/65 |
| 6,499,828 B1 | | 12/2002 | Iketani et al. | 347/42 |
| 6,527,377 B1 | | 3/2003 | Ikegame et al. | 347/56 |
| 6,659,588 B1 | | 12/2003 | Ikegame et al. | 347/40 |
| 6,808,252 B1 | | 10/2004 | Ohashi et al. | 347/47 |
| 6,869,168 B1 | * | 3/2005 | Terui | 347/50 |

FOREIGN PATENT DOCUMENTS

JP 2002-187273 A 7/2002

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

An ink jet print head is provided which includes: a print element substrate; a plate accommodating the print element substrate by enclosing a side peripheral portion of the print element substrate; an electric wiring tape member disposed on the plate and having electric wiring portions for the print element substrate; a first sealant filling a space surrounding the print element substrate enclosed by the plate; and a second sealant covering a part of the electric wiring portions. In this construction, stress concentrations in the electric connections are alleviated even if the electric wiring tape used to support the second sealant has a reduced stiffness due to a reduced thickness of the tape. For this purpose, the plate H1401' is provided with protrusions H1402 as support members that support the second sealant H1308 through the extension portions H1305 of the electric wiring tape.

7 Claims, 14 Drawing Sheets

INK JET PRINT HEAD

BACKGROUND OF THE INVENTION

1. Field of the Invention

The present invention relates to an ink jet print head that ejects ink onto a surface of a print medium to form an image and more particularly to an ink jet print head having a flexible film substrate mounted on a substrate formed with print elements to generate energy for ejecting ink.

2. Description of the Related Art

An ink jet printing system generally comprises an ink jet print head having nozzles or ejection openings to eject ink and a supply system to supply ink to the print head.

FIGS. 1 to 3 are perspective views showing a representative example of an ink jet print head. This construction basically can properly apply the present invention described later.

An ink jet print head H1000 generally comprises a print element unit H1002, an ink supply unit H1003 and a tank holder H2000. As shown in FIG. 3, the print element unit H1002 has a first print element substrate H1100, a second print element substrate H1101, a first plate H1200 used as a base, an electric wiring tape H1300 serving as a flexible wiring member, an electric contact substrate H2200, and a second plate H1400 for accommodating the print element substrates. These are assembled and mounted on the ink supply unit H1003. The ink supply unit H1003 has an ink supply member H1500, a flow path forming member H1600, a joint seal member H2300, a filter H1700 and a seal rubber H1800. These are assembled and accommodated in the tank holder H2000.

Here, the construction of the print element unit H1002 will be explained.

The print element unit H1002 is generally manufactured in the following processes.

Process 1: Forming a plate assembly by joining the first plate H1200 and the second plate H1400.

Process 2: Mounting two print element substrates H1100 and H1101 on the plate assembly.

Process 3: Positioning electrode terminals H1302 of the electric wiring tape H1300 and electrode portions of the print element substrates, and joining the electric wiring tape to the plate assembly.

Process 4: Connecting the electrode terminals H1302 of the electric wiring tape H1300 and the electrode portions of the print element substrates.

Process 5: Sealing the electrical connections.

Each of the above processes will be detailed in the following.

Process 1

The first plate H1200 is formed with ink supply ports H1201 to supply a black ink to the first print element substrate H1100 and cyan, magenta and yellow inks to the second print element substrate H1101. The second plate H1400 is joined to the first plate H1200 in a way that exposes the ink supply ports H1201. Where the ink supply ports H1201 are exposed, the second plate H1400 joined to the first plate H1200 is formed with device holes H1401 to accommodate the two print element substrates H1100, H1101.

Process 2

The first print element substrate H1100 and the second print element substrate H1101 are securely bonded with high precision to the exposed portions of the first plate H1200 through the device holes H1401. The positioning of the first and second print element substrates is made with respect to an X-direction positional reference surface H1204 and a Y-direction positional reference surface H1205 both formed in the first plate H1200. The print element substrates each having a plurality of ink ejection openings have a known construction employed in an ink jet print head.

Process 3

The electric wiring tape H1300 is a laminate of a base film, copper foil wires and a wire protecting cover film or solder resist. The base film may, for example, be formed of a polyimide resin to a thickness of about 25–125 μm. The copper foil wires have a thickness of 35 μm and are formed in a predetermined shape to connect the two print element substrates to the electric contact substrate H2200. Portions of the electric wiring tape H1300 that the print element substrates are built into, are formed with device holes H1304 of almost the same shape as the device holes H1401. At two sides of each of the device holes H1304 which correspond to the electrode portions of the print element substrates, electrode terminals H1302 plated with gold on their surface are arrayed as connection terminals. The electric wiring tape H1300 is secured on its cover film side to the surface of the second plate H1400 through a thermosetting epoxy resin bonding layer. The base film of the electric wiring tape H1300 is made smooth on its surface as it is engaged with a capping member of the print element unit.

Process 4

Electric connection between the electric wiring tape H1300 and the two print element substrates is made by performing an inner lead bonding (abbreviated ILB) on the electrode terminals H1302 of the electric wiring tape H1300 and bumps provided in advance on the electrode portions of the print element substrates, for example.

Process 5

When the electric connections are exposed after ILB, the electrode portions are covered and sealed with a sealant H1308 (FIG. 2) with excellent sealing and ion interruption capabilities, such as epoxy resin, because fine ink sprays flying from ejection openings or ink drops bouncing back from a print medium may adhere to the electrode portions, corroding the electrode portions and base metals. To form liquid-tight ink communication paths running from the ink supply ports H1201 to ejection openings H1107, the surrounding of each print element substrate and gaps between the print element substrates and the device holes are covered with a sealant H1307.

The sealant (first sealant) H1307 applied to the surroundings of the print element substrates is chosen to have a high fluidity and a high elasticity so that the sealant when hardened will not cause stresses such as hardening shrinkage to the print element substrate. The other sealant (second sealant) H1308 applied to the electric connections is chosen to have a high hardness to provide such properties as wear resistance against rubbing motions of a rubber wiper blade to wipe off ink drops adhering to an ejection opening forming face and durability against being flaked off should a print medium contact it.

Then, the electric terminal contact member H1303 on an electric input side of the electric wiring tape H1300 and the electric contact substrate H2200 to transfer electric signals from the printing apparatus body are connected together by, for instance, an ACF (Anisotropic Conductive Film) and the terminal connection portions are also covered with a sealant.

The print element unit H1002 assembled in the above processes and the ink supply unit H1003 are joined together through the joint seal member H2300. Screws H2400 are fastened into screw fixing bosses H1517 in the ink supply unit H1003 through screw setting positions H1207 provided in two screw setting portions H1206 of the first plate. At this time, the positional reference surfaces H1204, H1205 of the first plate and its back surface engage abutment portions H1509, H1510, H1511 of the ink supply unit H1003. This positions the print element unit H1002 in the X direction (main scan direction), Y direction (sub-scan direction) and Z direction (ink ejection direction). The electric contact substrate H2200 is positioned and fixed by a terminal positioning pins H1515 and terminal connecting pins H1516 of a terminal fixing portion H1512 of the ink supply unit H1003 coming into terminal positioning holes H1309 and terminal connecting holes H1310 of the electric contact substrate.

Then, the tank holder H2000 is mounted on the assembly of the print element unit H1002 and the ink supply unit H1003 to provide an ink jet print head H1000 of FIG. 1. When ink tanks (not shown) are installed in the tank holder H2000, ink is supplied from the filter H1700 of the ink supply unit H1003 into the ink paths H1501 in the flow path forming member H1600. Ink is further fed from an ink introducing port H1602 into the print element unit H1002.

Although the ink jet print head described above has a black ink ejection portion and a color ink ejection portion formed integral as one piece, the similar manufacturing process can also be applied to an ink jet print head with separate print element substrates for individual colors.

The ink jet print head, however, has the following problems that may degrade reliability.

As described above, the second sealant H1308 that covers the electric connections between the electric wiring tape H1300 and the print element substrates is hard and highly durable. Thus, where the second sealant H1308 is placed over the soft first sealant H1307, which seals the outer periphery of the print element substrates, may be cracked when applied a local external force as the first sealant H1307 deforms. From these cracks ink may seep in, leading to corrosion of electric connections.

To solve this problem, a method has been proposed (see Japanese Patent Application Laid-open No. 2002-187273) which involves extending the base film of the electric wiring tape H1300 at both ends of the arrays of the electrode terminals H1302 slightly into the device holes and applying the second sealant H1308 over the extension portions H1305 so as to cover the electric connections. This document also discloses that the extension portions H1305 may have a conductive layer to particularly enhance stiffness.

SUMMARY OF THE INVENTION

As the ink jet printing apparatus have come into widespread use, there is a growing demand for a reduction in cost of the print head used in the apparatus. To meet this demand, it is essential to lower the cost of elements making up the print head. When the base film and the copper foil layer making up the electric wiring tape H1300, which are relatively expensive parts, are reduced in thickness as part of the cost reduction effort, it is highly unlikely that the above-mentioned problem cannot be avoided completely with the above construction left unchanged.

This problem will be explained by referring to FIG. 4A and FIG. 4B. FIG. 4A schematically illustrates the electric wiring tape and device hole and their associated parts in the print element unit, as seen from a side where arrays H1108 of ink ejection openings H1007 are formed (surface opposing a print medium). FIG. 4B is a schematic cross section taken along the line IVB—IVB of FIG. 4A.

As shown in FIG. 4A, when a technique disclosed in Japanese Patent Application Laid-open No. 2002-187273 is applied, the base film of the electric wiring tape H1300 is extended toward both ends of arrays of the electrode terminals H1302 of the tape connected to the electrode portions H1104 of the first print element substrate H1100 in such a way as to cover parts of space between the first print element substrate H1100 and the device hole H1401, with the second sealant H1308 covering the electric connections and the extension portions H1305.

However, when the first sealant H1307 deforms (e.g., due to hardening shrinkage) as shown in FIG. 4B, the extension portions H1305 at the corners of the device hole H1304 of the electric wiring tape H1300 also deform toward the bottom of the device hole as indicated by arrows. Since the second sealant H1308 is hard, it cannot follow the deformation, causing local stress concentrations, degrading connection stability.

In light of the problem described above, the present invention has been accomplished to provide a highly reliable ink jet print head that clears the above problem.

The print head of this invention therefore comprises:

a print element substrate disposed on a base and having print elements for ejecting ink and electrode portions to receive a power supply for driving the print elements;

an accommodating unit to accommodate the print element substrate by enclosing a side peripheral part of the print element substrate, the accommodating unit being mounted on the base;

a resilient wiring member disposed on the accommodating unit and having wiring portions formed thereon to be connected to the electrode portions of the print element substrate;

a first sealant filling a space surrounding the print element substrate enclosed by the accommodating unit;

a second sealant covering the electrode portions of the print element substrate and a part of the wiring portions of,the wiring member corresponding to the electrode portions; and a support member situated in the space to support the second sealant on the base.

With this invention stress concentrations in the electric connections which are feared to occur as a result of reducing the thickness of the base film and copper foil layer making up a wiring member such as an electric wiring tape, which are the relatively expensive wiring member, can be alleviated thereby enhancing the reliability. The provision of the support member that supports the second sealant can improve the reliability and manufacturing stability of the connecting portions between the print element substrate and the wiring member even if the wiring member is reduced in thickness to lower the cost. Particularly if protrusions are provided inside the device hole, which defines the print element substrate accommodating space in the accommodating unit (second plate) that can be formed of a relatively inexpensive material, the number of parts does not increase nor does the part cost rise. Therefore it is possible to provide a highly reliable ink jet print head at low cost.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, the present invention will be described in detail by referring to the accompanying drawings.

First Embodiment

Figure 1:
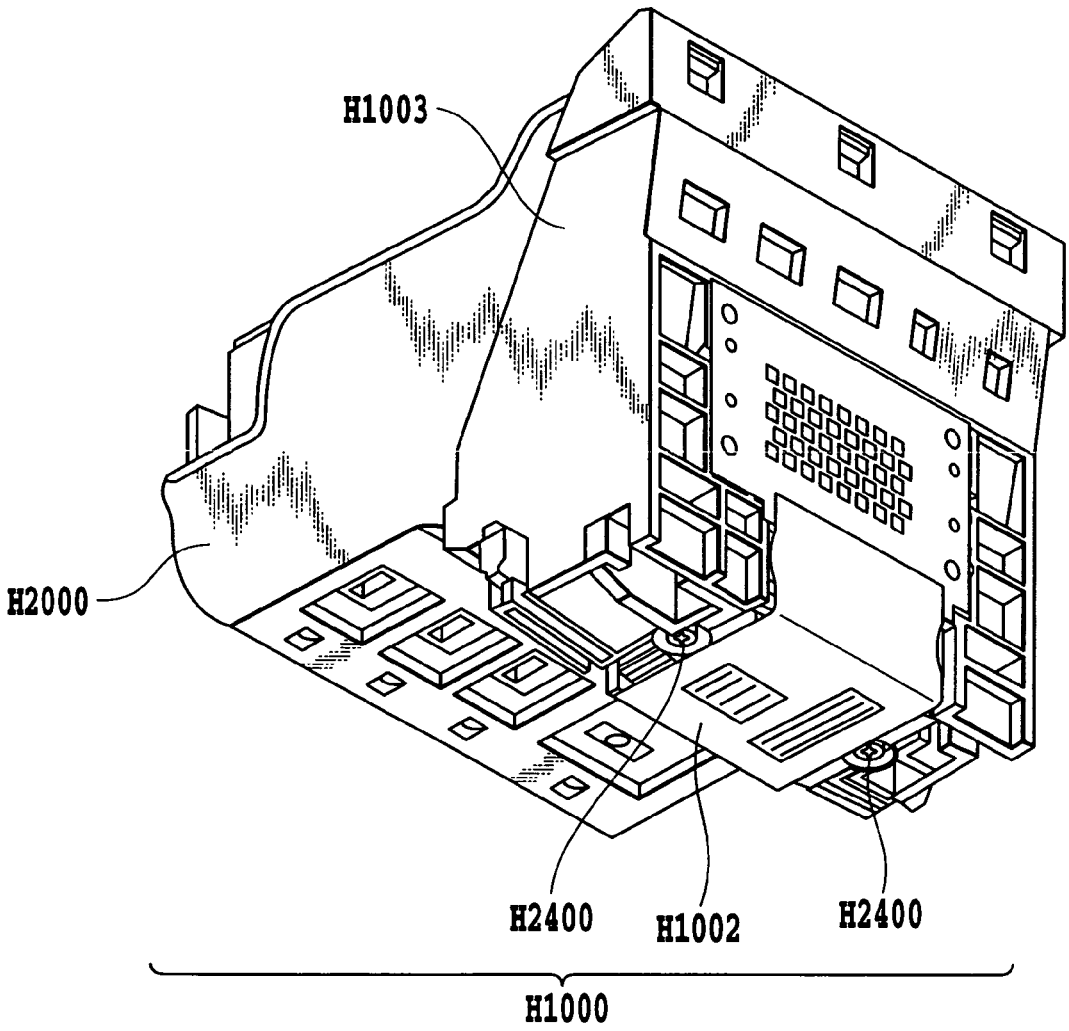
FIG. 1 is a perspective view of an example ink jet print head that can apply the present invention.
Figure 2:
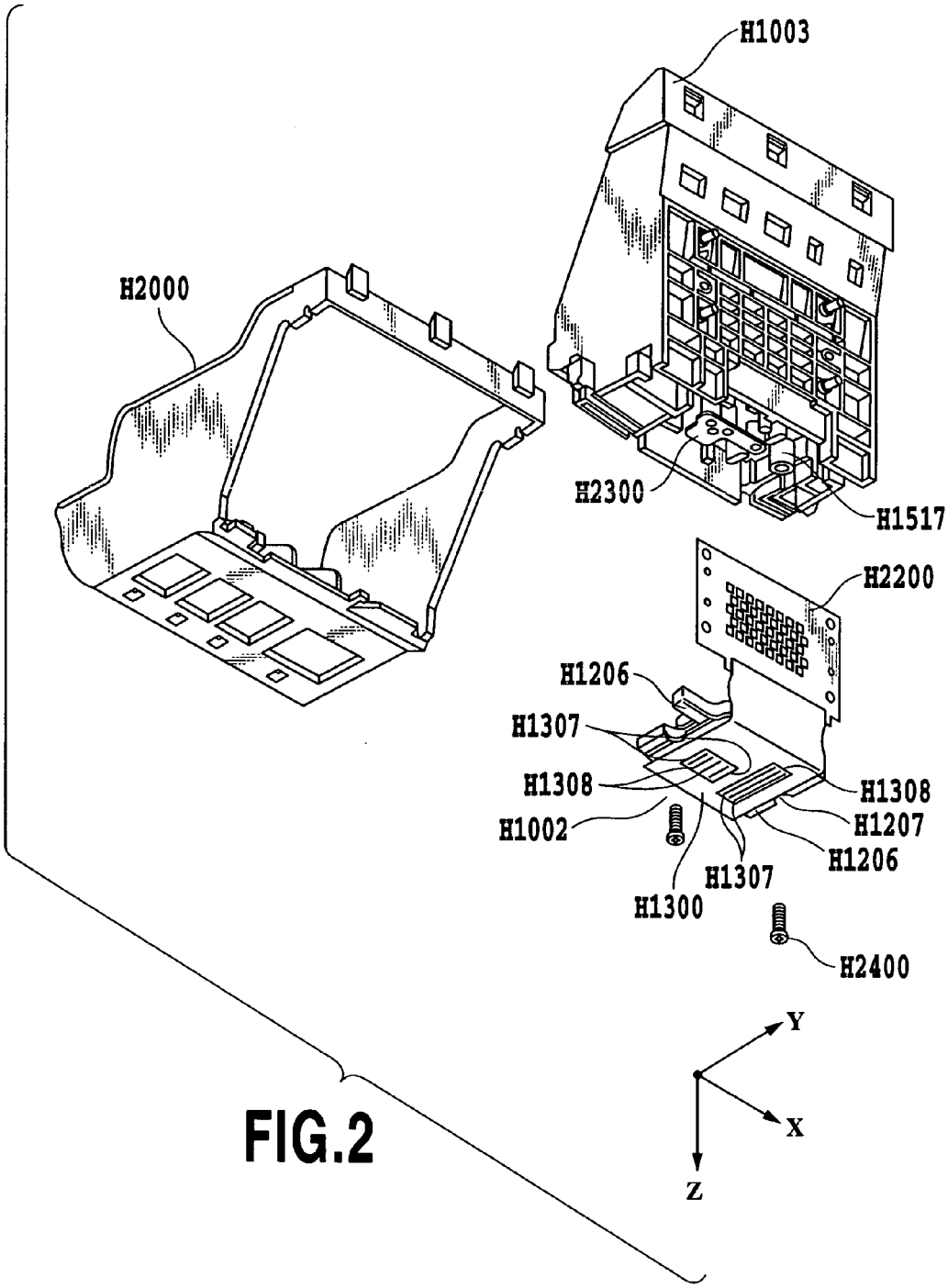
FIG. 2 is an exploded, perspective view of a print element unit, an ink supply unit and a tank holder, main constitutional components of the ink jet print head of FIG. 1.
Figure 3:
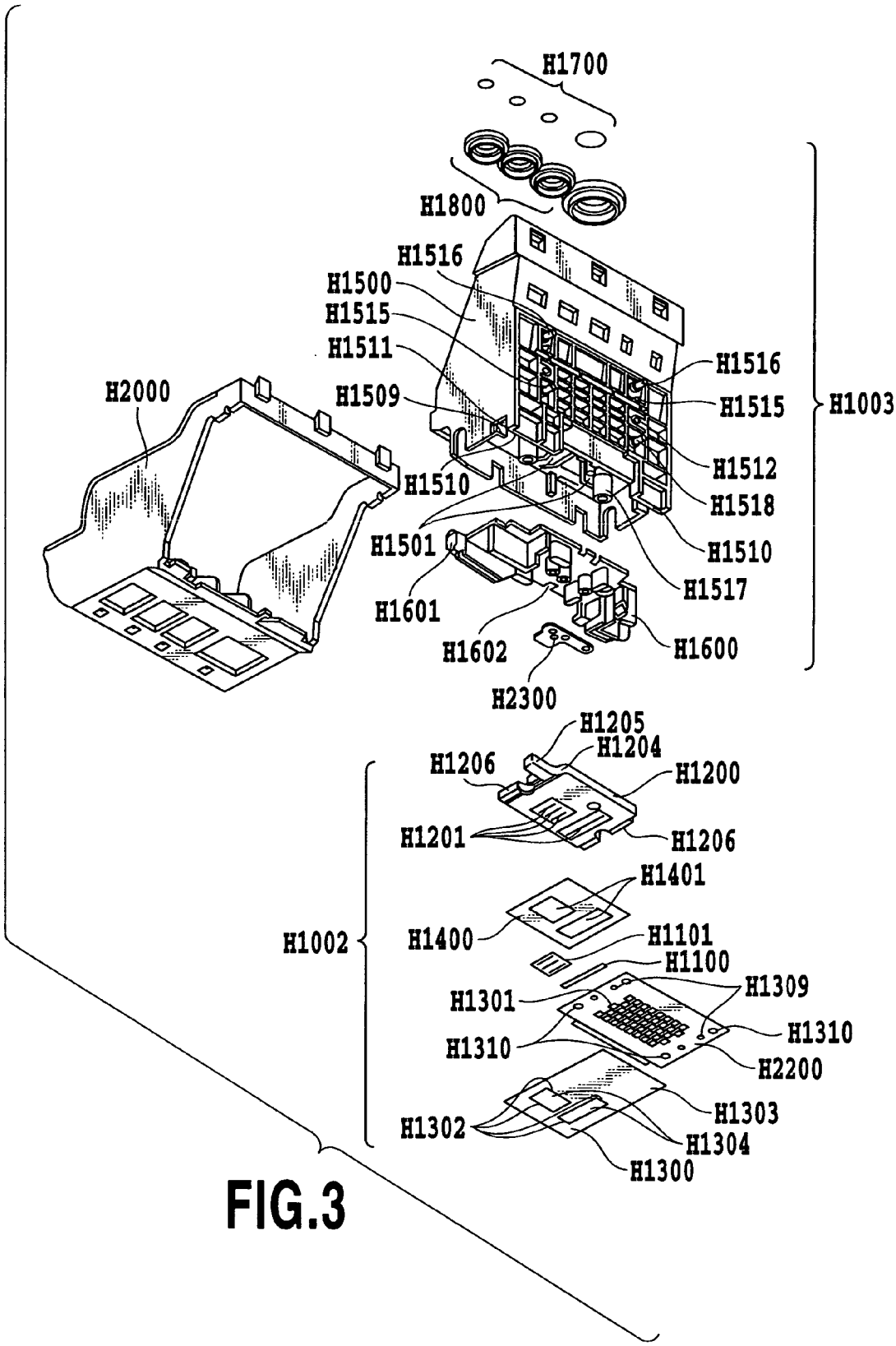
FIG. 3 is a further exploded, perspective view of each of the print element unit and the ink supply unit of FIG. 2.
Figure 4A:
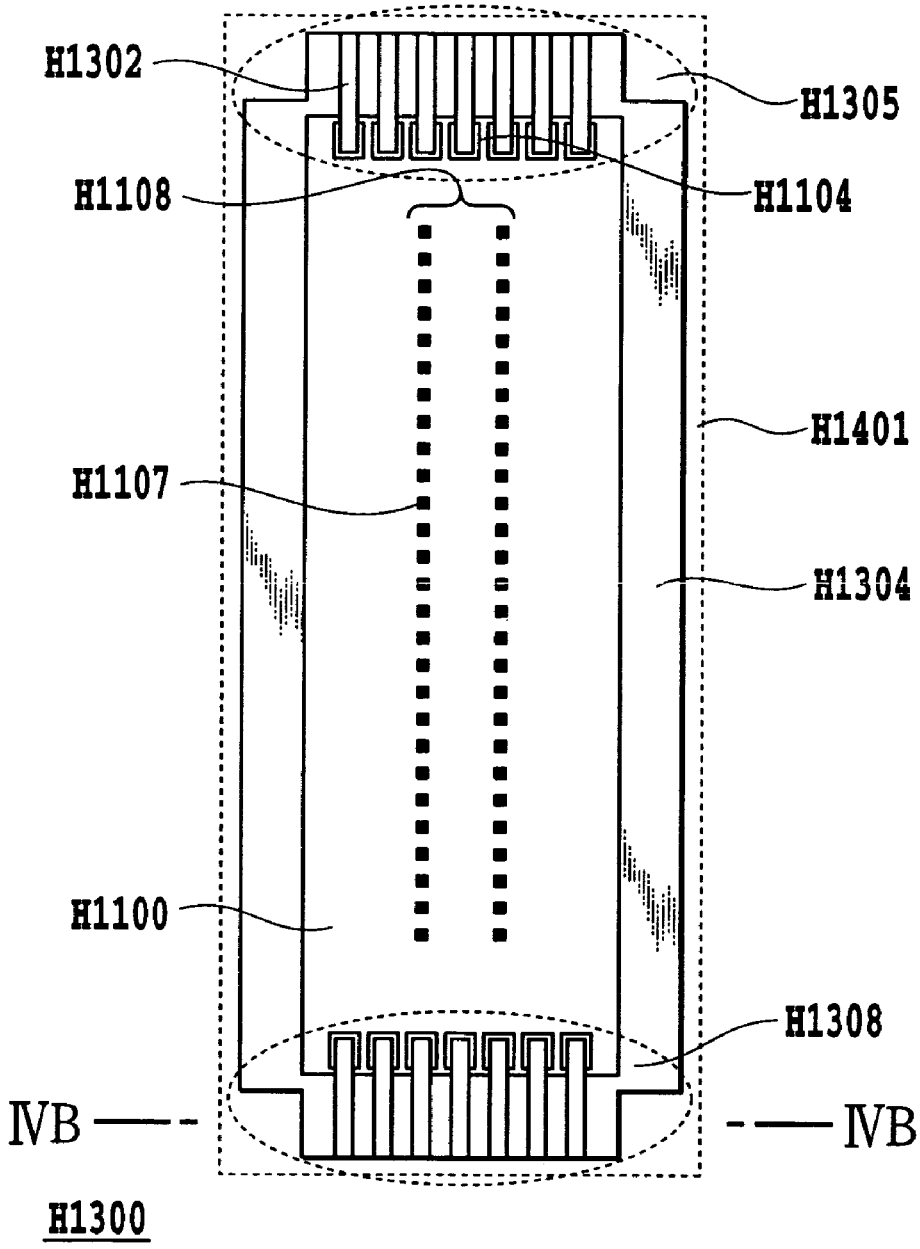
PRIOR ART FIG.4A
FIG. 4A and FIG. 4B are, respectively, a schematic view of an electric wiring tape and a device hole and their associated components of the conventional print element unit, as seen from a side facing a print medium, and a schematic cross section taken along the line IVB—IVB of FIG. 4A.
Figure 4B:
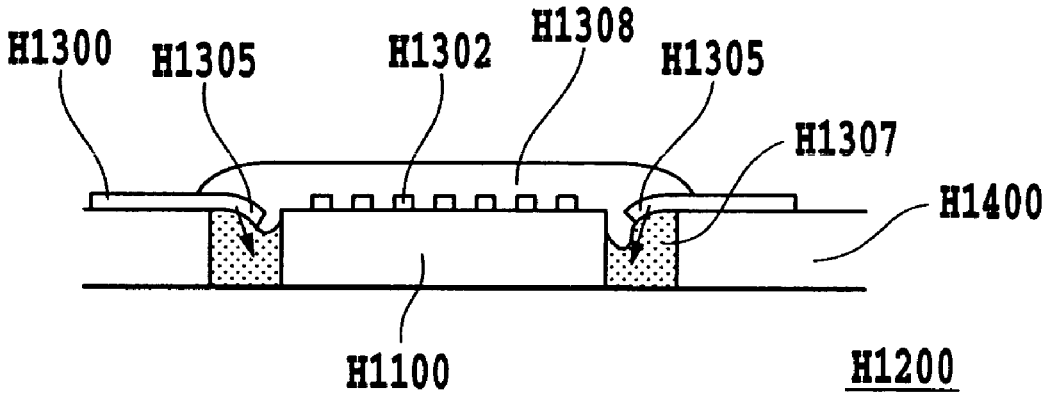
PRIOR ART FIG.4B
Figure 5:
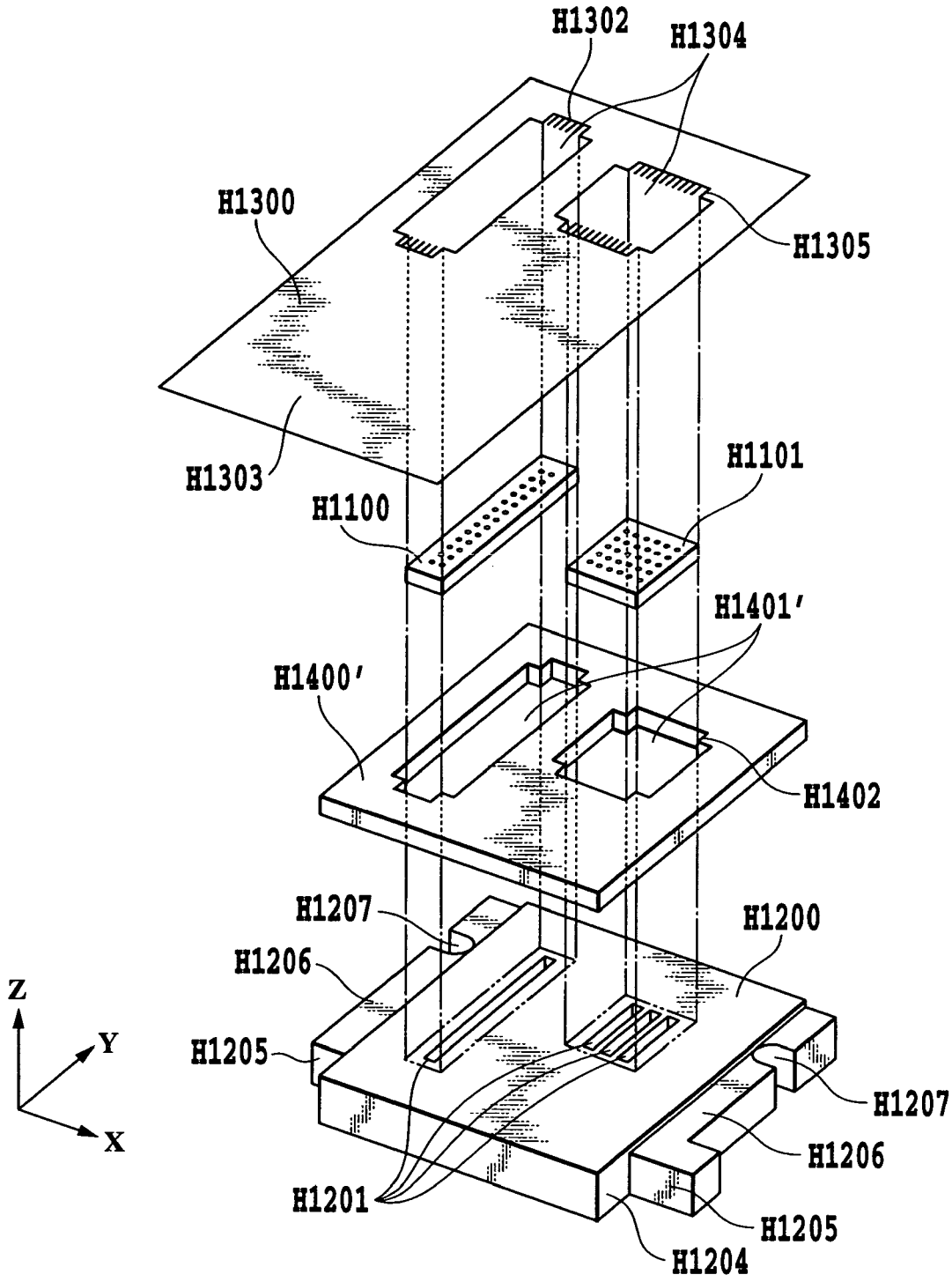
FIG. 5 is an exploded perspective view of a print element unit according to a first embodiment of this invention.
Figure 6A:
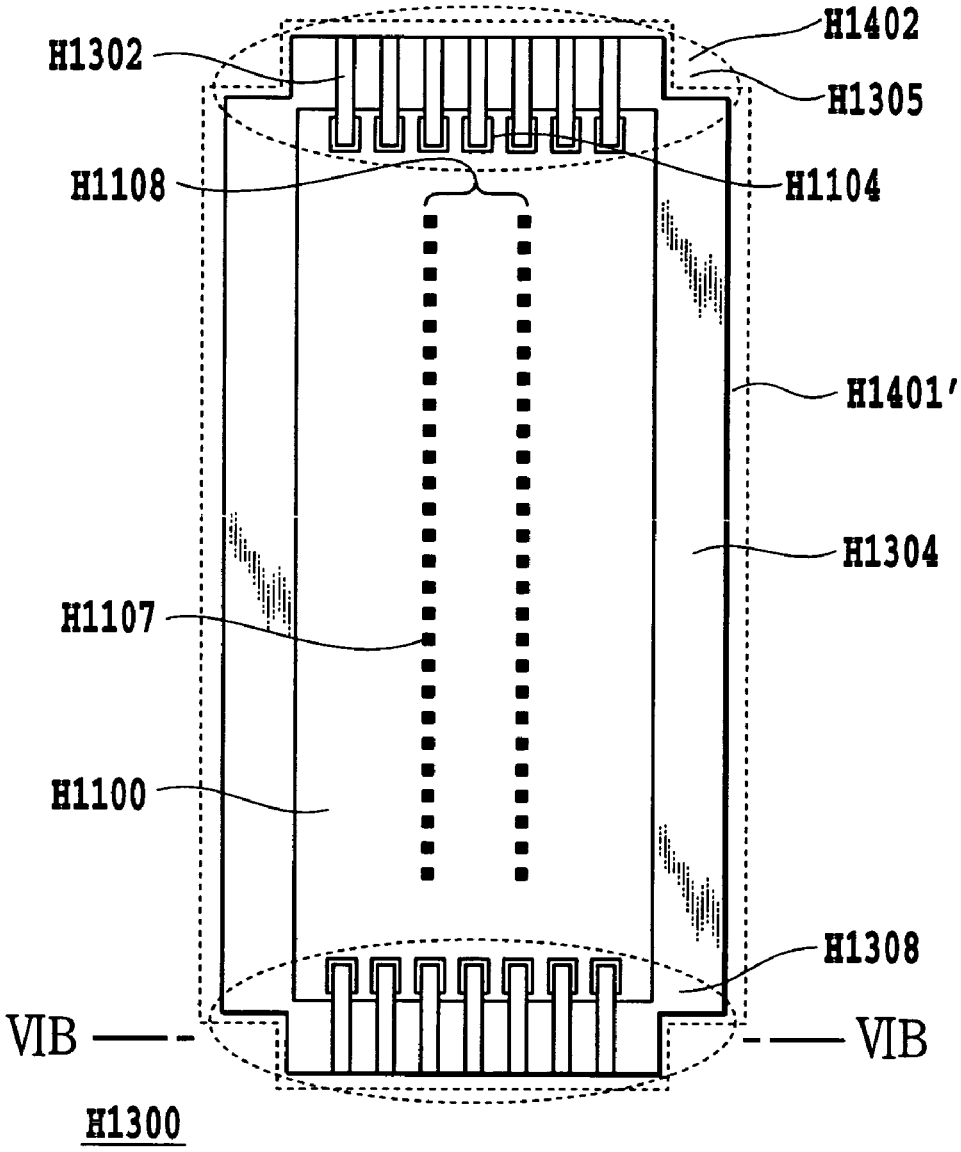
FIG. 6A and FIG. 6B are, respectively, a schematic view of an electric wiring tape and a device hole and their associated components of the print element unit of FIG. 5, as seen from a side facing a print medium, and a schematic cross section taken along the line VIB—VIB of FIG. 6A.
Figure 6B:
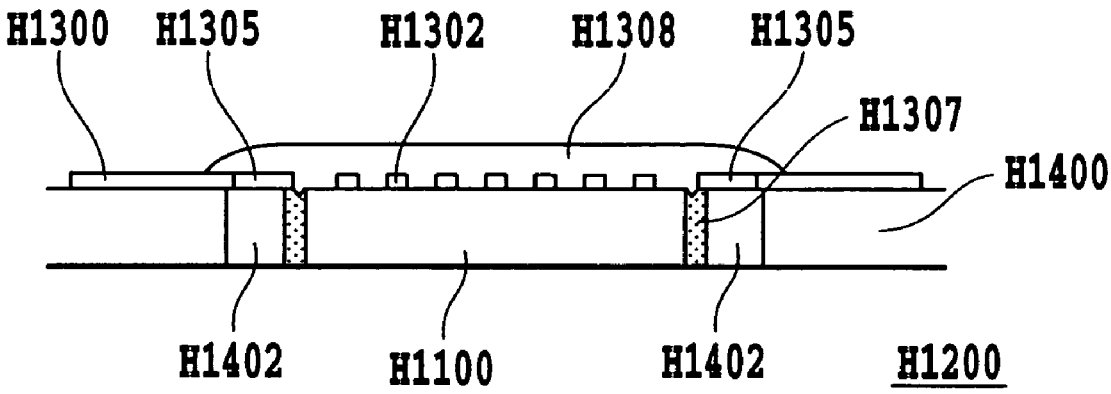

FIG. 5 is an exploded perspective view of a print element unit according to the first embodiment of this invention. FIG. 6A is a schematic view showing an electric wiring tape and a device hole and their associated parts in the print element unit as seen from a side where arrays H1108 of ink ejection openings H1007 of the first print element substrate H1100 are formed (a surface facing a print medium). FIG. 6B is a schematic cross sectional view taken along the line VIB—VIB of FIG. 6A. In these figures, parts identical with those of FIGS. 1 to 3, FIG. 4A and FIG. 4B are assigned like reference numerals.

This embodiment differs from the construction of FIG. 4A and FIG. 4B in that protrusions H1402 corresponding to the device hole extension portions H1305 of the electric wiring tape H1300 are provided at four corners of each device hole in the second plate H1400' for the first and second print element substrate H1100 and H1101. The protrusions H1402 may be formed integral with the second plate H1400' when the second plate H1400' is molded from a base material such as ceramic, resin or metal. With this embodiment, this was achieved easily and at low cost by modifying a punched alumina ($Al_2O_3$) green sheet.

Using the second plate H1400' formed in this manner, the print element unit H1002 is assembled in the process described above, so that the device hole extension portions H1305 of the electric wiring tape are supported by the protrusions H1402 of the second plate, as shown in FIG. 6B. Thus, if the first sealant H1307 undergoes hardening shrinkage, the above construction prevents a generation of a force which would otherwise deflect the extension portions H1305 downward and thereby deform the second sealant H1308. Thus, no local stress concentrations occur in the electric connections between the print element substrates and the electric wiring tapes, protecting the connection stability. As a result, a highly reliable ink jet print head can be provided.

In this embodiment, the extension portions H1305 are provided on the electric wiring tape side to support the second sealant H1308. In this construction the extension portions H1305 are formed to positively protrude toward the electric connections to ensure that a step at the end of the electric wiring tape is not situated near the periphery of the sealant H1308, thereby making the step coverage of the sealant H1308 stable and satisfactory. If the peeling of the sealant H1308 due to such a step does not become an issue, the extension portions H1305 may not be provided on the electric wiring tape side and instead the protrusions H1402 of the second plate can be directly covered with the sealant H1308, i.e., the protrusions H1402 of the second plate can directly support the sealant H1308. This can also be said of second and third embodiment.

While this embodiment has almost square protrusions H1402 at corners of the device hole H1401' of the second plate H1400', the shape of the protrusions is not limited to this one as long as they can effectively support the device hole extension portions H1305 of the electric wiring tape or the second sealant H1308. For example, their square edge portions may be chamfered in an inclined surface or in a curved surface. The protrusions of such shapes can still be molded easily and as one piece with the second plate and produce the similar effect.

The second plate H1400' does not affect the construction of other parts of the print element unit and thus does not require significant changes in the basic design and manufacturing process of the print element unit. Therefore, for the print element substrates H1100 and H1101 the known construction of the ink jet print head can be employed. The construction of the print element substrates will be briefly explained referring FIGS. 7 and 8.

Figure 7:
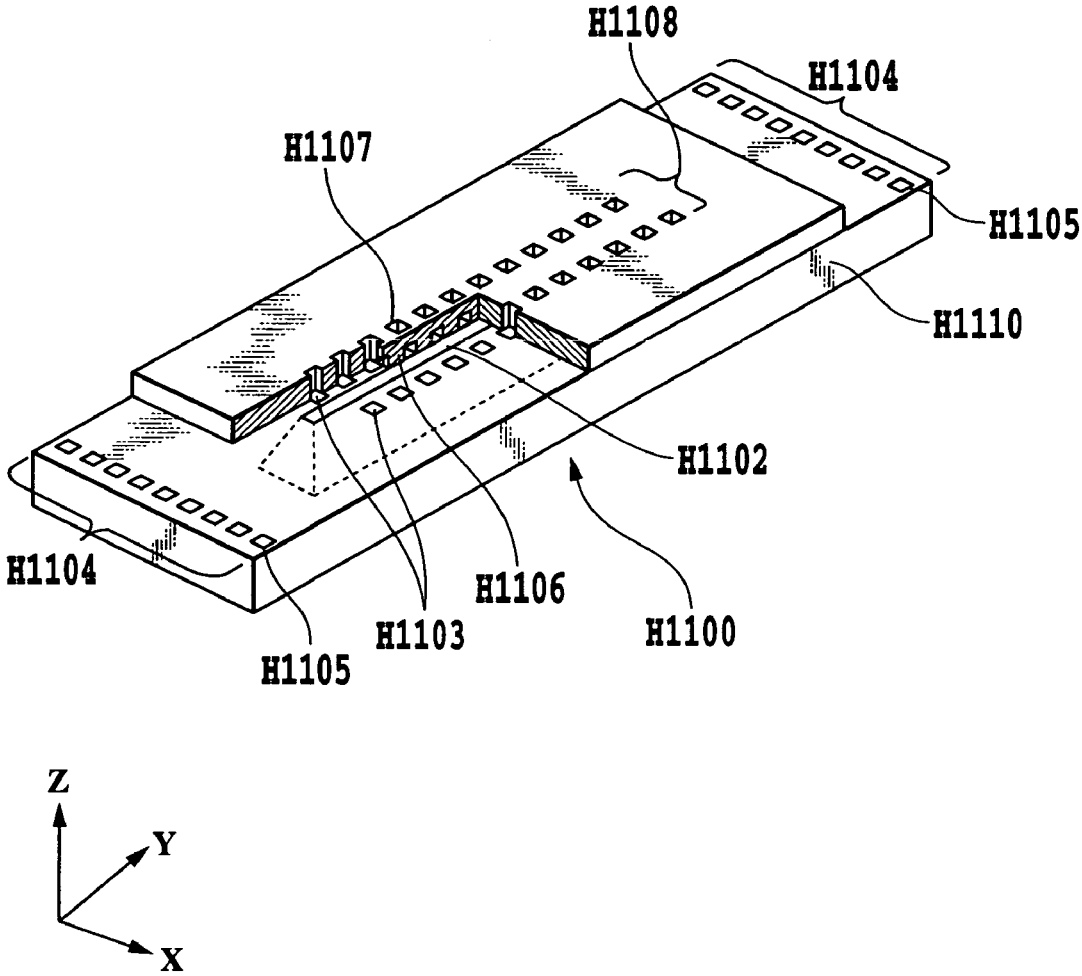
FIG. 7 is a perspective view showing a construction of a first print element substrate of the ink jet print head that can apply the present invention.
Figure 8:
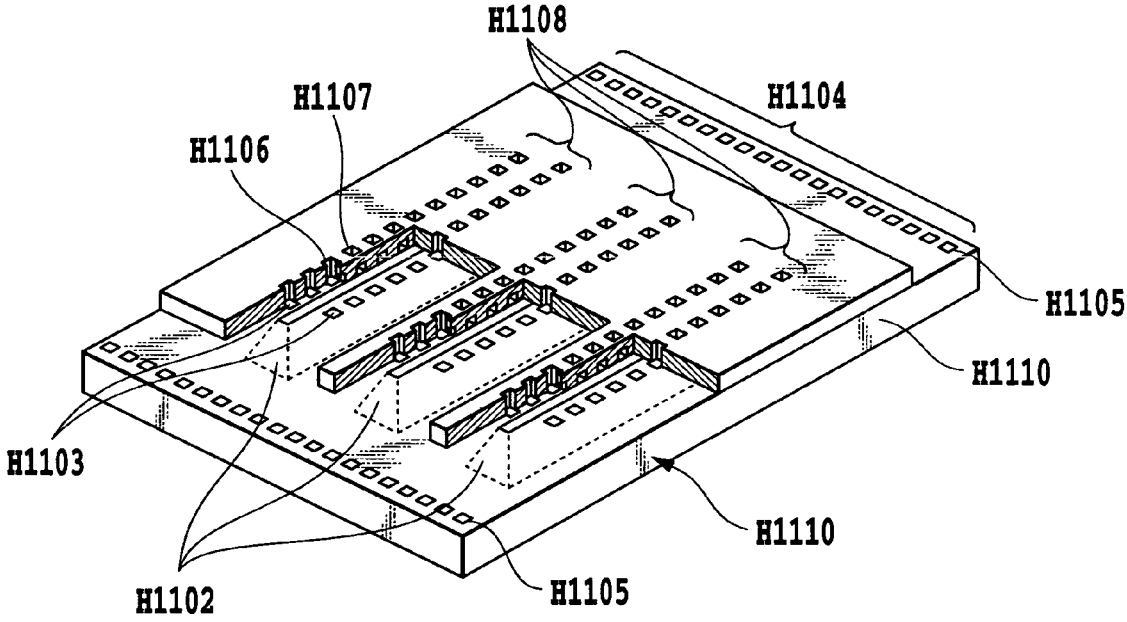
FIG. 8 is a perspective view showing a construction of a second print element substrate of the ink jet print head that can apply the present invention.

FIG. 7 shows the first print element substrate H1100 for a black ink. FIG. 8 shows the second print element substrate H1101 for color inks. Both of the print element substrates are formed of a silicon substrate H1110 0.5–1 mm thick having ink supply paths H1102 one for each color in the form of a long groovelike through-hole, to which the associated inks are introduced from the ink introducing port H1602 (FIG. 3) of the ink supply unit H1003. Further, on each side of the ink supply path H1102 of each color is arranged an array of electrothermal transducers H1103 as ejection energy generation means, with the two electrothermal transducer arrays staggered from each other by one-half pitch in the Y direction. At positions corresponding to the electrothermal transducers there are liquid paths formed by ink path walls H1106 and arrays H1108 of ink ejection openings H1107 communicated with the liquid paths and adapted to eject ink onto a print medium. The second print element substrate H1101 for color inks has integrally formed therein all columns of ejection openings for three colors, yellow, magenta and cyan, with two columns used for each color. The ejection opening columns for individual colors may also be formed in separate pieces.

Further, along two sides of the print element substrate in a direction (X direction in the figure) perpendicular to the direction of array of the electrothermal transducers H1103 (Y direction in the figure) are formed electrode portions H1104 for connecting the electrothermal transducers formed on the first print element substrate and a drive circuit built into the first print element substrate with external circuits. In the electrode portions H1104 ball bumps (stud bumps) H1105 of Au, for example, are formed as by a wire bonding device for connection with the electrode terminals H1302 of the electric wiring tape H1300.

Means for generating ink ejection energy are not limited to the electrothermal transducers, which, when energized, generate thermal energy to heat and create a bubble in ink, and other forms of energy generation means may be employed.

The print head H1100 assembled by using the print element unit H1002 constructed as shown in FIG. 5 can be mounted on printers, copying machines, facsimiles with a communication system and word processors with a printer unit, and also on industrial printing devices used in combination with a variety of processing devices. By using this ink jet print head, it is possible to print on a variety of print media, such as paper, threads, fibers, cloth, leather, metal, plastics, glass, wood, and ceramics. Word "print" in this specification means imparting to print media not only images having significance or meaning such as letters and figures, but also images with no meaning such as patterns.

Figure 9:
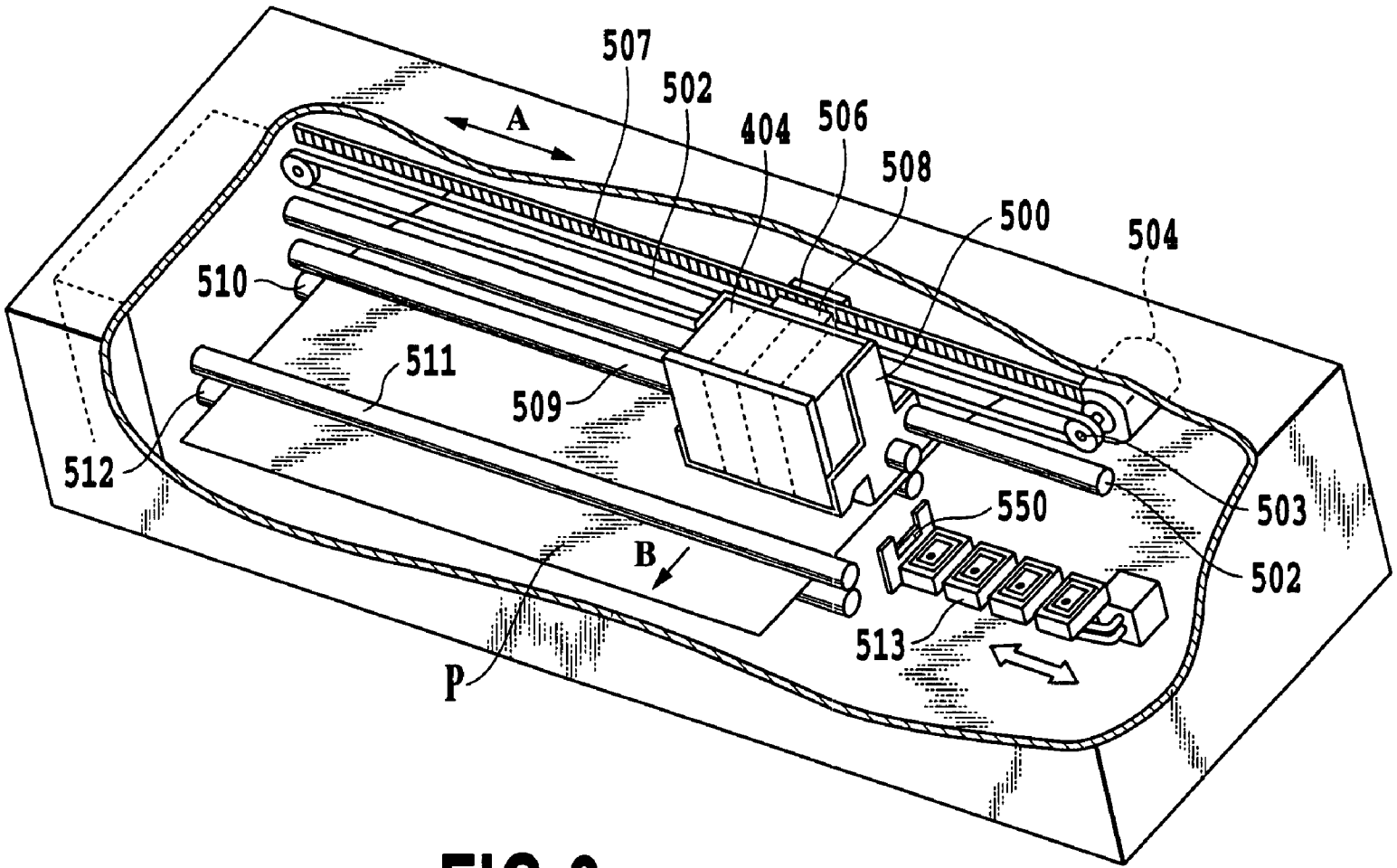
FIG. 9 is a schematic perspective view showing an example construction of an ink jet printing apparatus using the ink jet print head applying this invention.

FIG. 9 is a schematic perspective view showing an example construction of an ink jet printing apparatus using the ink jet print head described above. In this apparatus, a carriage 500 is fixed to an endless belt 501 and is movable along a guide shaft 502. The endless belt 501 is wound on pulleys 503, one of which is connected with a drive shaft of a carriage drive motor 504. Thus, as the motor 504 is operated, the carriage 500 is reciprocally driven (in direction A) along the guide shaft 502 for a main scan. On the carriage 500 is mounted the cartridge type ink jet print head H1000 which is attached with the same number of ink tanks 404 as the ink colors used.

This apparatus has a linear encoder 506 to detect a position of the carriage in the main scan direction. The linear encoder 506 has as one constitutional element a linear scale 507 provided along the direction of travel of the carriage 500 which is formed with slits at a predetermined density and at equal intervals. The linear encoder 506 has as the other constitutional element a slit detection system 508 having a light emitting portion and a light sensor and a signal processing circuit. Thus, as the carriage 500 moves, the linear encoder 506 outputs an ejection timing signal for determining an ink ejection timing and carriage position information.

Paper P as a print medium is intermittently fed in a direction B perpendicular to the scan direction of the carriage 500. The paper P is supported by a pair of roller units 509, 510 situated upstream in the direction of paper transport and by a pair of roller units 511, 512 situated downstream and is given a predetermined tension by these rollers to secure a flatness or planarity with respect to an ejection opening forming face of the print element unit H1002 as it is transported. A driving force to each roller unit is transmitted from a paper feed motor not shown.

In the above construction, the printing over the same width as the length of the ejection opening arrays of the ink jet print head while the carriage 500 moves and the feeding of paper P are repetitively alternated until the whole paper P is printed.

The carriage 500 stops at a home position as required at a print start time or during a printing operation. At this home position is provided a cap member 513 that caps the ejection opening forming face of each ink jet head (in which ejection openings are formed). The cap member 513 has a suction-based recovery means (not shown) to forcibly suck out ink from ejection openings to prevent possible clogging of the ejection openings. At the home position a wiping member 550 to wipe clean the ejection opening forming face of the print element unit H1002 is arranged vertically movable.

Second Embodiment

Figure 10:
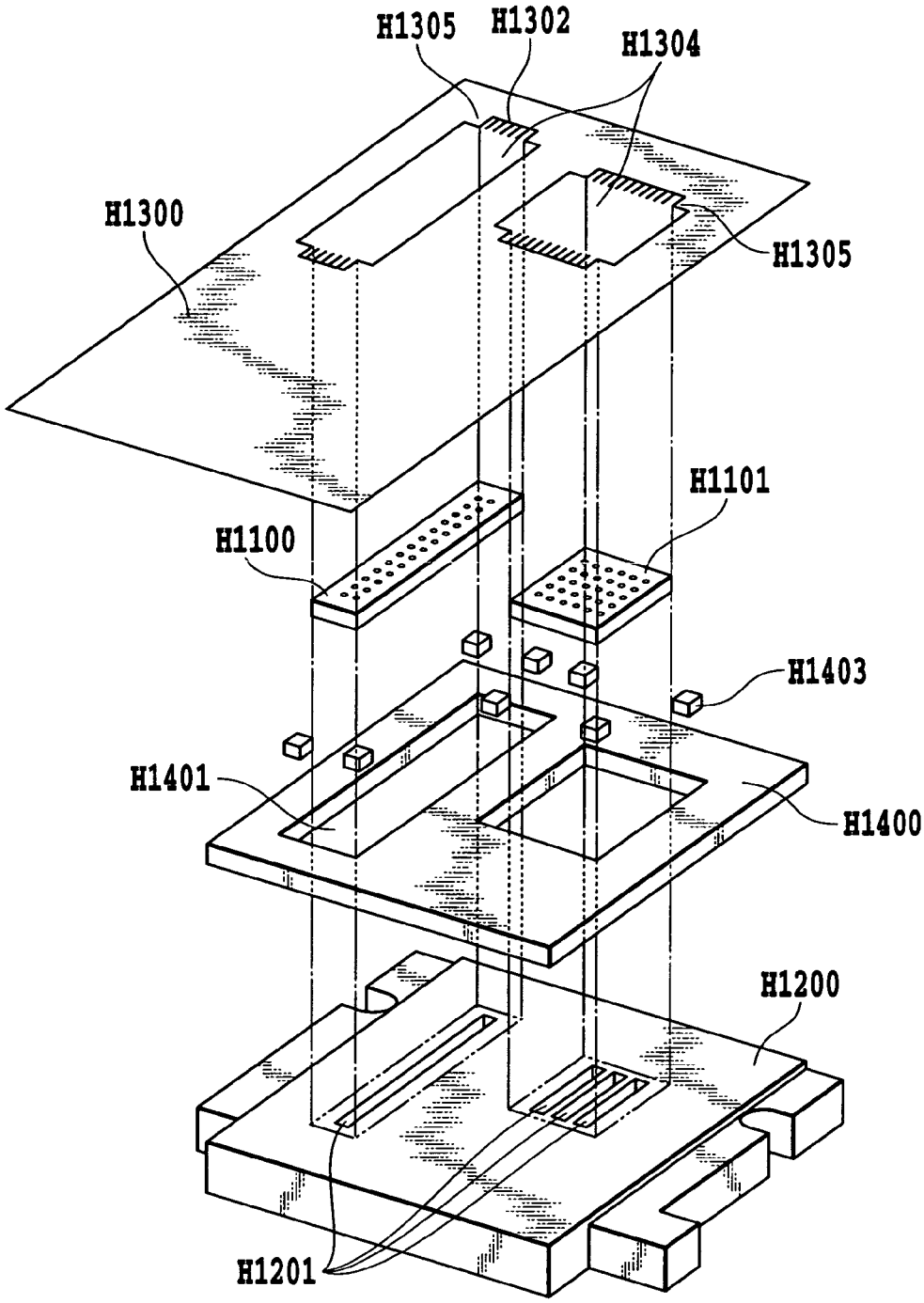
FIG. 10 is an exploded perspective view of a print element unit according to a second embodiment of this invention.

FIG. 10 is an exploded perspective view of a print element unit according to a second embodiment of this invention. In the figure, parts identical with those of FIG. 1 to FIG. 3, FIG. 4A and FIG. 4B are given like reference numbers.

This embodiment differs from the construction of FIG. 5 in that while the second plate H1400 is used which has the device holes H1401 of the same shapes as shown in FIG. 4A and FIG. 4B, support members H1403 of the same height as the depth of the device holes H1401 of the second plate are arranged at four corners of each of the device holes H1401 of the first and second print element substrates H1100, H1101 so that they are situated below the device hole extension portions H1305 of the electric wiring tape. In this example, small cubic support members H1403 (0.6 mm×0.6 mm×0.6 mm) are formed of acrylic material and, after the first and second plates H1200, H1400 have been assembled together, are bonded to the four corners of each of the device holes H1401.

In other steps, the print element unit H1002 is assembled in the similar manner to have the device hole extension portions H1305 of the electric wiring tape supported on the support members H1403. Thus, if the first sealant H1307 undergoes hardening shrinkage, the downward deflection of the extension portions H1305 can be blocked, preventing local stress concentrations in the electric connections between the print element substrate and the electric wiring tape, thereby maintaining the connection stability. It is therefore possible to provide a highly reliable ink jet print head.

Third Embodiment

Figure 11:
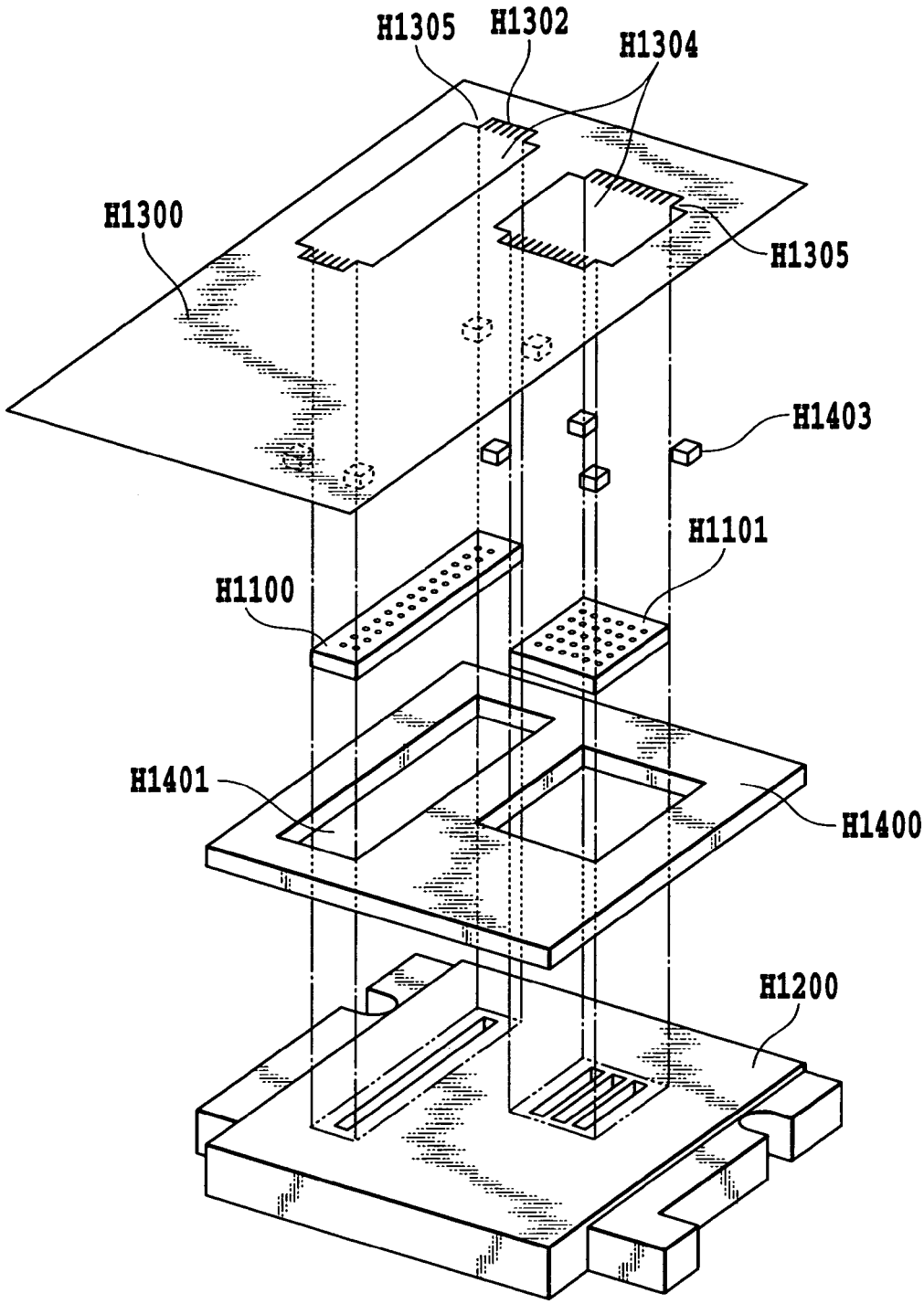
FIG. 11 is an exploded perspective view of a print element unit according to a third embodiment of this invention.

FIG. 11 shows a third embodiment as a variation of the second embodiment. In this example, on a back side of the device hole extension portions H1305 of the electric wiring tape, i.e., on the side facing the device holes H1401, acrylic support members H1403 of the same thickness as the depth of the device hole are arranged to produce the similar effect to that of the second embodiment.

In other steps the print element unit H1002 is assembled in the similar manner to have the device hole extension portions H1305 of the electric wiring tape supported on the support members H1403. Thus, if the first sealant H1307 undergoes hardening shrinkage, the downward deflection of the extension portions H1305 can be blocked, preventing local stress concentrations in the electric connections between the print element substrate and the electric wiring tape, thereby maintaining the connection stability. It is therefore possible to provide a highly reliable ink jet print head.

It is noted that the shape of the support members is not limited to the cube or the like as long as they can effectively support the device hole extension portions H1305 of the electric wiring tape or the second sealant H1308. The material of the support members is also not limited to acrylics but may use inexpensive and easily formed materials, such as metal, ceramics and easily molded resin.

Fourth Embodiment

Figure 12:
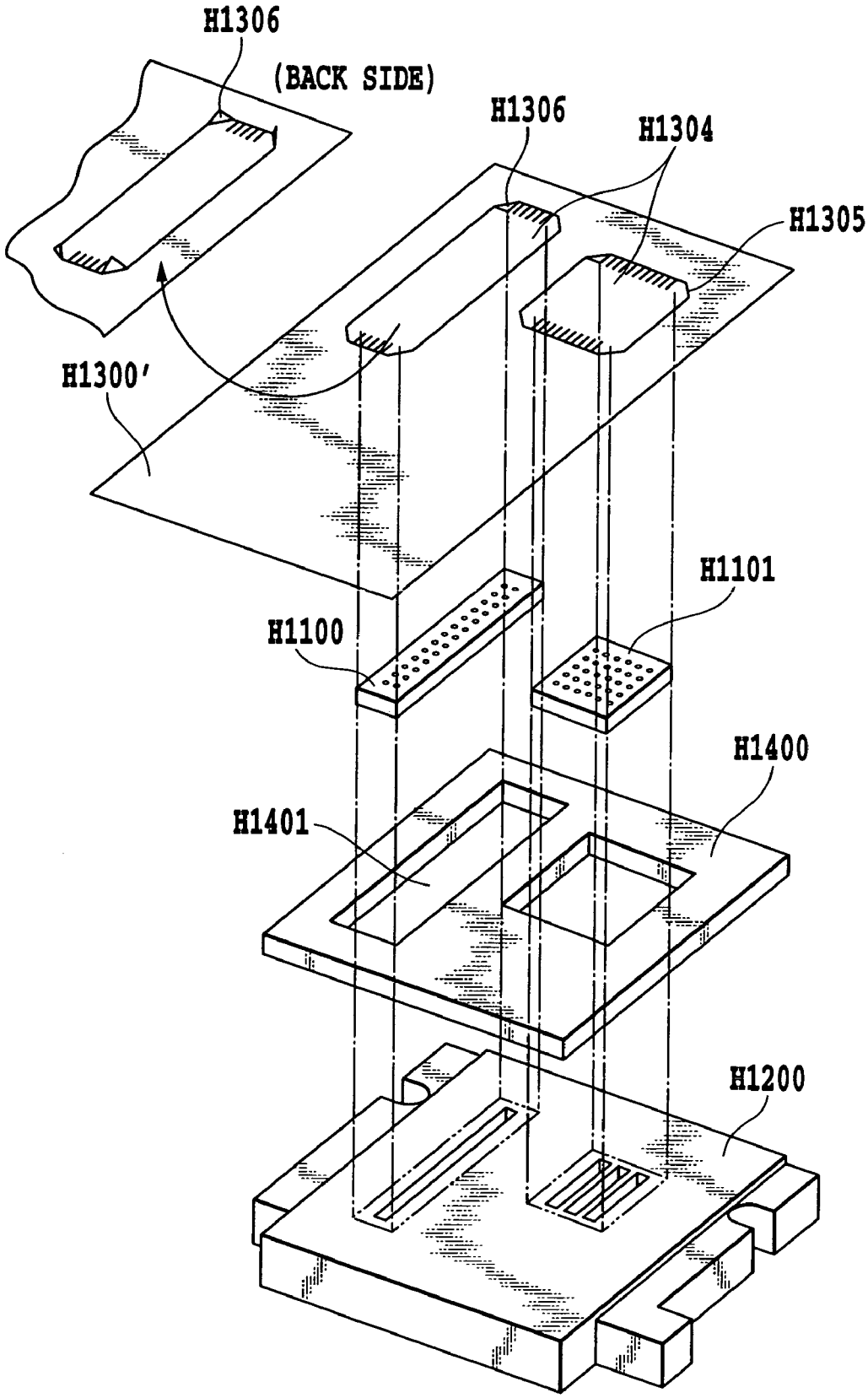
FIG. 12 is an exploded perspective view of a print element unit according to a fourth embodiment of this invention.

FIG. 12 is an exploded perspective view of a print element unit according to a fourth embodiment of this invention. In this embodiment, while the second plate H1400 having the device holes H1401 of the same shapes as shown in FIG. 4A and FIG. 4B is used, those protruding portions of the electric wiring tape at the extension portions H1305 are folded toward the back side, i.e., toward the device hole H1401 of the second plate H1400 to form folded portions H1306 which are used as support members to support the device hole extension portions H1305 of the electric wiring tape or the second sealant H1308. The size of the folded portions is set to 0.6 mm, equal to the height of the device holes H1401. This arrangement ensures that if, after the assembly is done as described above, the first sealant H1307 undergoes hardening shrinkage, the tips of the folded portions H1306 support the electric wiring tape and blocks its downward deflection, preventing local stress concentrations in the electric connections between the print element substrate and the electric wiring tape, thereby maintaining the connection stability. It is therefore possible to provide a highly reliable ink jet print head.

The size of the folded portions may be set otherwise. That is, the front ends of the folded portions H1306 need not completely contact the upper surface of the first plate H1200. The folded portions H1306 can be sized to allow deformation of the electric wiring tape to such a degree that no undesirable local stress concentrations occur in the electric connections between the electric wiring tape and the print element substrate.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2003-415727 filed Dec. 12, 2003, which is hereby incorporated by reference herein.

What is claimed is:

1. An ink jet print head comprising:

a print element substrate disposed on a base and having print elements for ejecting ink and electrode portions to receive a power supply for driving the print elements;

an accommodating unit to accommodate the print element substrate by enclosing a side peripheral part of the print element substrate, the accommodating unit being mounted on the base;

a resilient wiring member disposed on the accommodating unit and having wiring portions formed thereon to be connected to the electrode portions of the print element substrate;

a first sealant filling a space surrounding the print element substrate enclosed by the accommodating unit;

a second sealant covering the electrode portions of the print element substrate and a part of the wiring portions of the wiring member corresponding to the electrode portions; and a support member situated in the space to support the second sealant on the base.

2. An ink jet print head according to claim 1, wherein the wiring member has portions protruding into the space and the support member supports the second sealant through the protruding portions.

3. An ink jet print head according to claim 1, wherein the support member is formed of ceramics, metal or resin.

4. An ink jet print head according to claim 1, wherein the support member is formed integral with the accommodating unit as protrusions of the accommodating unit that defines the space.

5. An ink jet print head according to claim 1, wherein the wiring member has portions protruding over the space and the support member is formed by folding the protruding portions toward the base.

6. An ink jet print head according to claim 1, wherein the print elements each have an electrothermal transducer to generate thermal energy for ejecting ink.

7. An ink jet print head according to claim 1, wherein the base is a member having a supply port to supply ink to the print element substrate.

* * * * *